US005500726A

United States Patent [19]

Aoyama et al.

[11] Patent Number: 5,500,726

[45] Date of Patent: Mar. 19, 1996

[54] FIXING DEVICE WITH SEPARATION MEMBER CAPABLE OF VARYING CONTACT PRESSURE

[75] Inventors: Takeshi Aoyama, Yokohama; Yasumi Yoshida, Kawasaki, both of Japan

[73] Assignee: Canon Kabushiki Kaisha, Tokyo, Japan

[21] Appl. No.: 168,504

[22] Filed: Dec. 22, 1993

[30] Foreign Application Priority Data

Dec. 28, 1992 [JP] Japan ..... 4-358602

[51] Int. Cl.[6] ..... G03G 15/20

[52] U.S. Cl. ..... 355/315; 271/311

[58] Field of Search ..... 355/315; 271/308, 271/311, 312, 313, 900; 219/216; 432/59, 60

[56] References Cited

U.S. PATENT DOCUMENTS 4,028,050 6/1977 Bar-on ..... 432/59

5,217,532 6/1993 Sasame et al. .

FOREIGN PATENT DOCUMENTS 59-184383 10/1984 Japan ..... 355/315

60-86572 5/1985 Japan ..... 355/315

61-32875 2/1986 Japan ..... 355/315

*Primary Examiner*—Joan H. Pendegrass

*Attorney, Agent, or Firm*—Fitzpatrick, Cella, Harper & Scinto

[57] ABSTRACT

Disclosed is a fixing device with a rotating member for performing a fixing operation by pinching and carrying a recording medium supporting an unfixed image. It separates a member pressing against the surface of the rotating member to separate the recording medium from the rotating member and its contact pressure is switchable between the first and second pressure, the second pressure being less than the first pressure and the switching taking place during the separation of the recording medium from the rotating member and after a front edge of the recording medium has separated.

6 Claims, 5 Drawing Sheets

FIXING DEVICE WITH SEPARATION MEMBER CAPABLE OF VARYING CONTACT PRESSURE

BACKGROUND OF THE INVENTION

1. Field of the Invention

The present invention relates to a fixing device for fixing an unfixed image on a recording medium.

2. Related Background Art

There are methods in which a recording medium supporting an unfixed image is nipped between and carried by a pair of rotating members to fix the image. Among them, the heating roller method is widely used.

According to the heating roller method, a separation claw which contacts the surface of a fixing roller is generally provided in order to separate the recording medium from the fixing roller.

The surface of the roller is coated with a rubber layer or a resin film in order to improve fixing and separability. But, as the separation claw is pressed against the surface of the roller during rotation, the surface of the roller may be scratched and damaged while frictionally sliding against the separation claw.

In order to solve this problem, the time during which the separation claw is in contact with the surface of the roller may be reduced. Thus, a solution for this problem is to provide a separation claw which can be attached to and detached from the roller, wherein the separation claw remains detached from the roller except when the front edge of the recording medium is to be separated.

However, when the separation claw is detached from the roller after separating the front edge of the recording medium, the retreating separation claw sometimes scratches and disturbs the image. And, when the recording medium is strongly adhered onto the surface of the roller as in case of a solid black image, separation can not be carried out properly.

In addition, as attachment and detachment of the separation claw should be executed for every recording medium, the separation claw has to be operated not only constantly but also swiftly, especially in a high-speed copying machine. Accordingly, the impact which is given when the separation claw comes into contact with the roller causes damage and scratches on the surface of the roller.

SUMMARY OF THE INVENTION

An object of the present invention is to provide a fixing device capable of reducing abrasion of the surface of the rotating member caused by the separation member without causing separation failure.

Another object of the present invention is to prevent the retreating separation claw from deteriorating the image.

Still another object of the present invention is to provide a fixing device comprising:

- a rotating member for performing fixation while a recording medium supporting an unfixed image is pinched and carried;
- a separation member pressed against a surface of the rotating member for fixation to separate the recording medium from the rotating member for fixation; and
- switching means for switching a contact pressure of the separation member between a first contact pressure and a second contact pressure less than the first contact pressure.

Other objects of the present invention will be clearly understood in the following description.

DETAILED DESCRIPTION OF THE PREFERRED EMBODIMENTS

Figure 4:
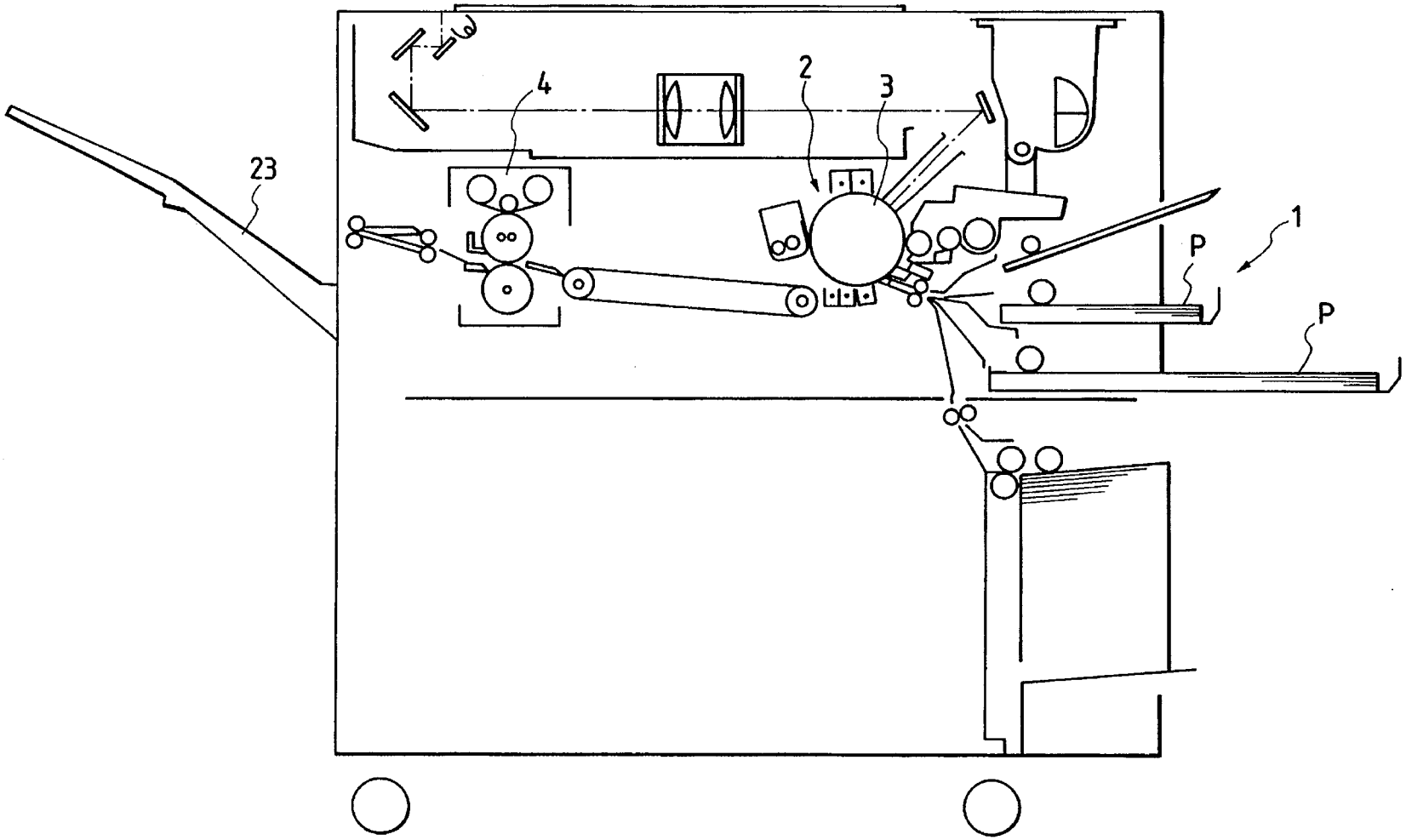
FIG. 4 is a view illustrating an embodiment of the image forming apparatus according to the present invention on which the device shown in FIG. 1 is mounted.

An embodiment of the present invention will be described below with reference to the accompanied drawings. FIG. 4 shows an image forming apparatus containing the fixing device according to the present invention. In this apparatus, a sheet P stacked in a sheet feed unit 1 is carried to an image forming unit 2, where a toner image formed on a photosensitive drum 3 in a well-known manner is transferred onto the sheet P. Subsequently, the toner image on the sheet P is fixed by a fixing device 4, and then, the sheet P is discharged onto a discharge tray 23.

Figure 1:
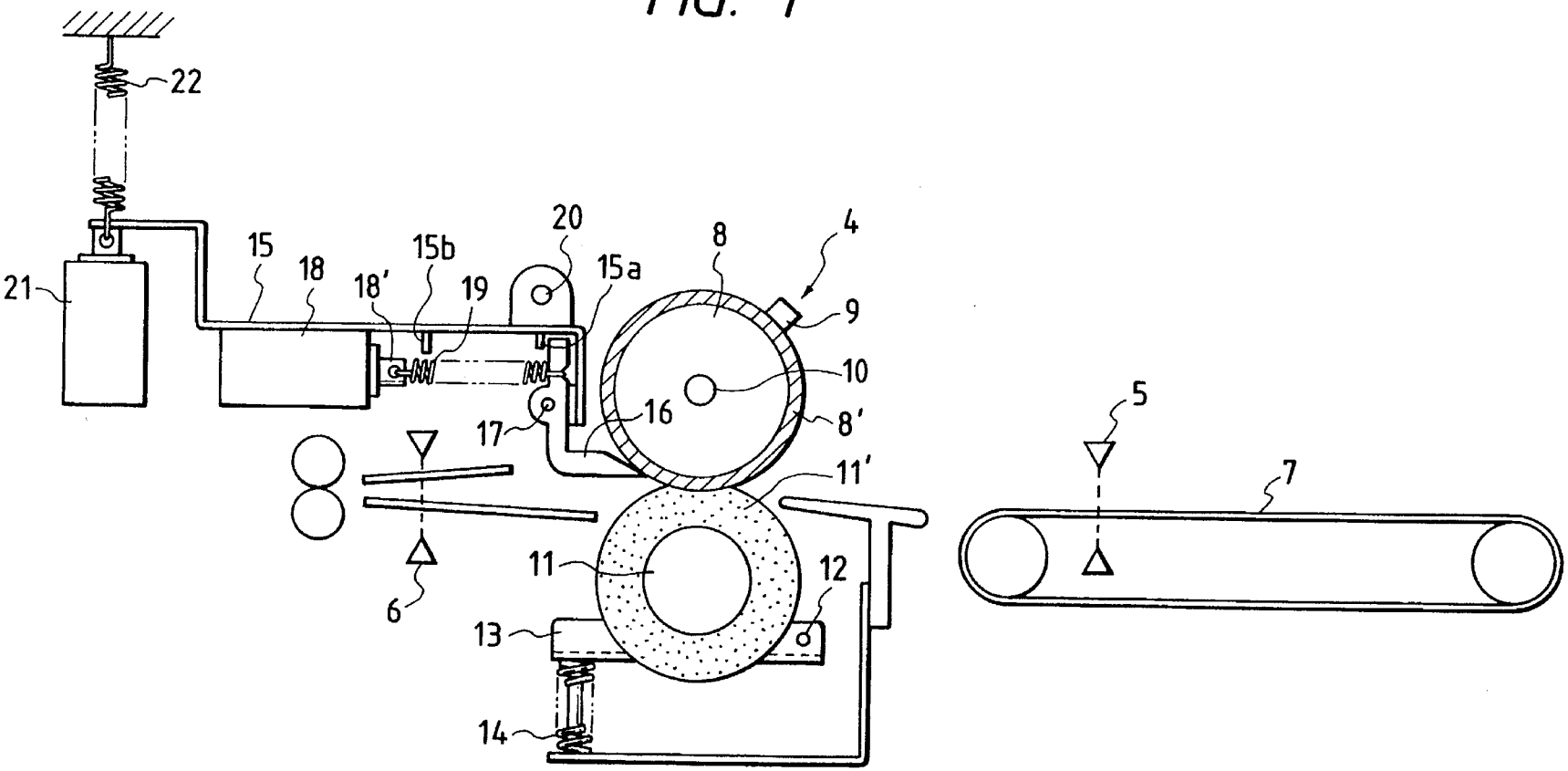
FIG. 1 is a view illustrating an embodiment of the device according to the present invention, wherein the separation claw is strongly pressed against the fixing roller; the first state.

FIG. 1 is a view in which the characteristics of the present invention are typically shown, thus the present invention will be described in detail with reference to this drawing. Sheet sensors 5 and 6 are arranged upstream and downstream, respectively, of the fixing device 4 to detect the carried sheet P. A carrier belt 7 carries the sheet P supporting the unfixed toner image from the image forming unit 2 to the fixing device 4. A fixing roller 8 is pivoted on a shaft, and its surface is coated with a fluoro resin layer 8'. The temperature of the fixing roller 8 is detected by a temperature sensor 9, and a heater 10 heats the fixing roller 8 up to a predetermined temperature. A pressure roller 11 is pivoted on the shaft of a pressure plate 13 which is supported around a supporting point 12 so as to be able to rock. Thus, a compression spring 14 attached to the pressure plate 13 presses the pressure roller 11 against the fixing roller 8. A rubber layer 11' is provided around the periphery of the pressure roller 11. A separation claw 16 is pivoted on a supporting point 17 of a rocking plate 15 so as to be able to rock. And a solenoid 18 is attached to the separation claw 16.

Figure 5:
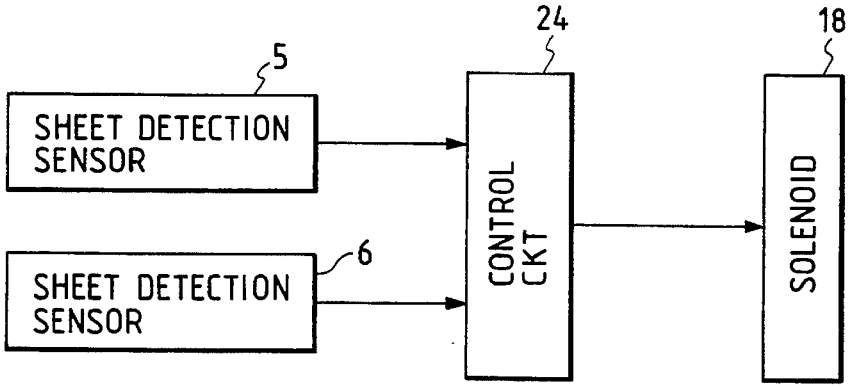
FIG. 5 is a system diagram for control of the solenoid in the device shown in FIGS. 1 to 3.

As shown in FIG. 5, the solenoid 18 is controlled by a control circuit 24 according to the detection signals from the sheet sensors 5 and 6. A tension spring 19 is set between the separation claw 16 and a plunger 18'. A reference numeral **15*a* denotes a stopper for restricting the rock of the separation claw 16 while the separation claw 16 is separated from the fixing roller 8. And a reference numeral 15*b* denotes a stopper for restricting the shift of the plunger 18' in order to restrict the contraction of the extension spring 19 while the solenoid 18 is turned off. The rocking plate 15 is pivoted on a fixed supporting point 20, and an end portion of the rocking plate 15 is fixed to the plunger of a solenoid 21. Accordingly, the rocking plate 15 is rocked by the pull of the solenoid 21 and the contraction of an extension spring 22**.

Figure 2:
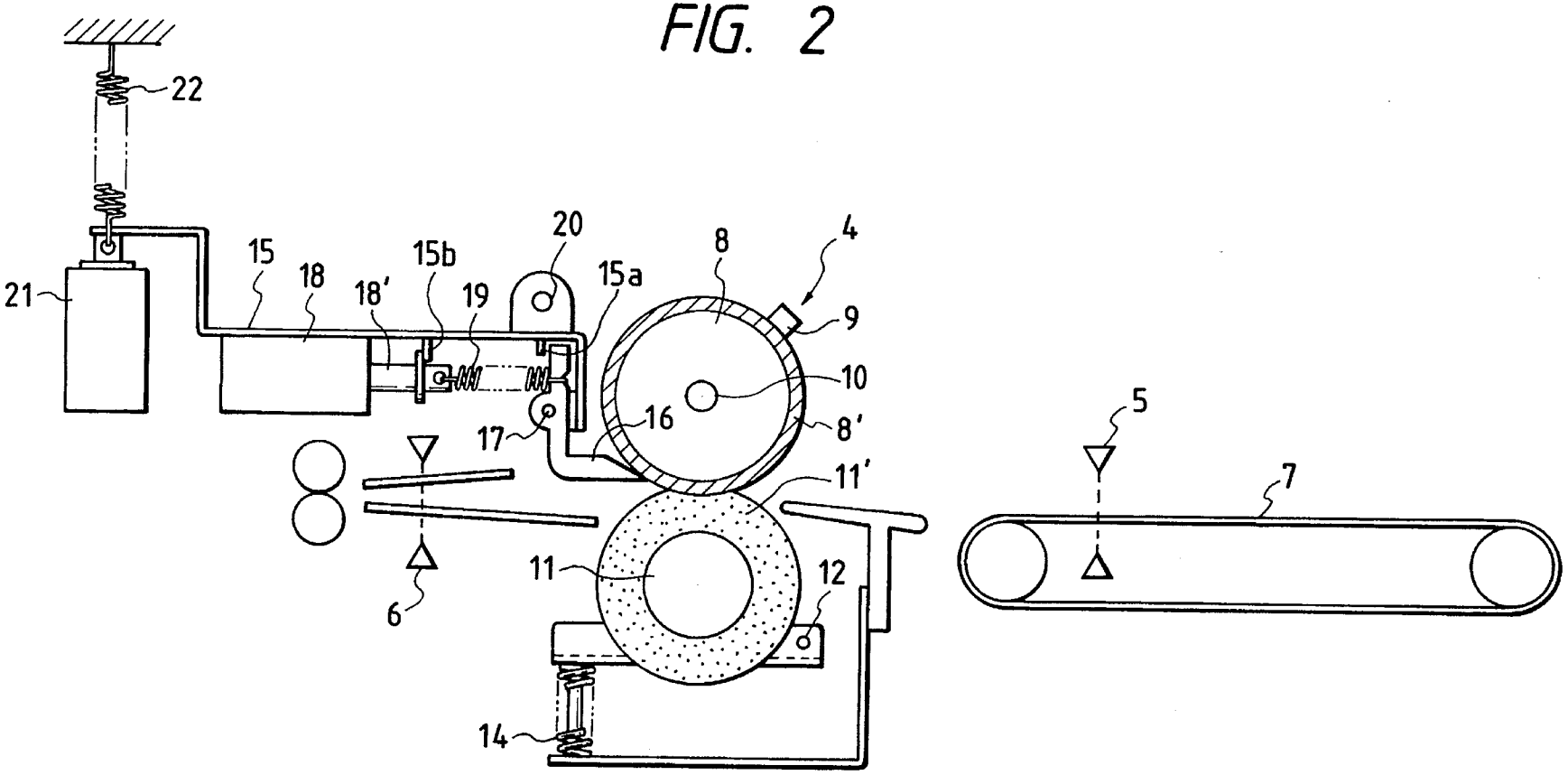
FIG. 2 is a view of the device shown in FIG. 1, wherein the separation claw is softly pressed against the fixing roller; the second state.
Figure 3:
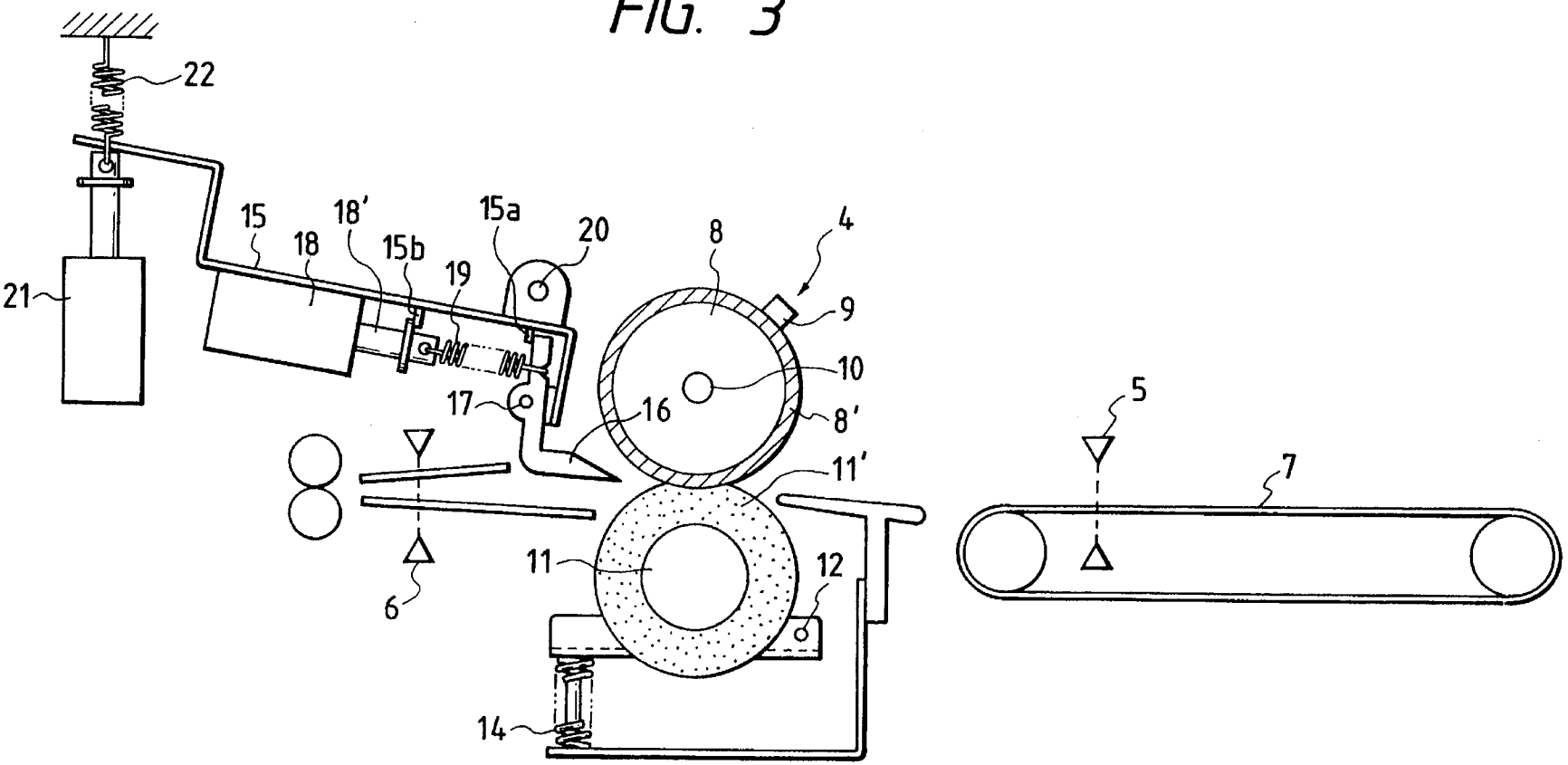
FIG. 3 is a view of the device shown in FIG. 1, wherein the separation claw is separated from the fixing roller; the third state.

A third state is shown in FIG. 3, in which when both the solenoid 18 and the solenoid 21 are turned off, the rock of the separation claw 16 is restricted by the stopper 15*a* and the separation claw 16 is reliably separated from the fixing roller 8 by the extension spring 22. A second state is shown in FIG. 2, in which when the solenoid 21 is turned on and the solenoid 18 is turned off, the plunger 18' is stopped by the stopper 15*b* and the separation claw 16 is relatively softly pressed against or is held closely to the fixing roller 8 by the extension spring 19. A first state is shown in FIG. 1, in which when both the solenoid 18 and the solenoid 21 are turned on, the separation claw 16 is pressed relatively strongly against the fixing roller 8 by the extension spring 19.

Figure 6:
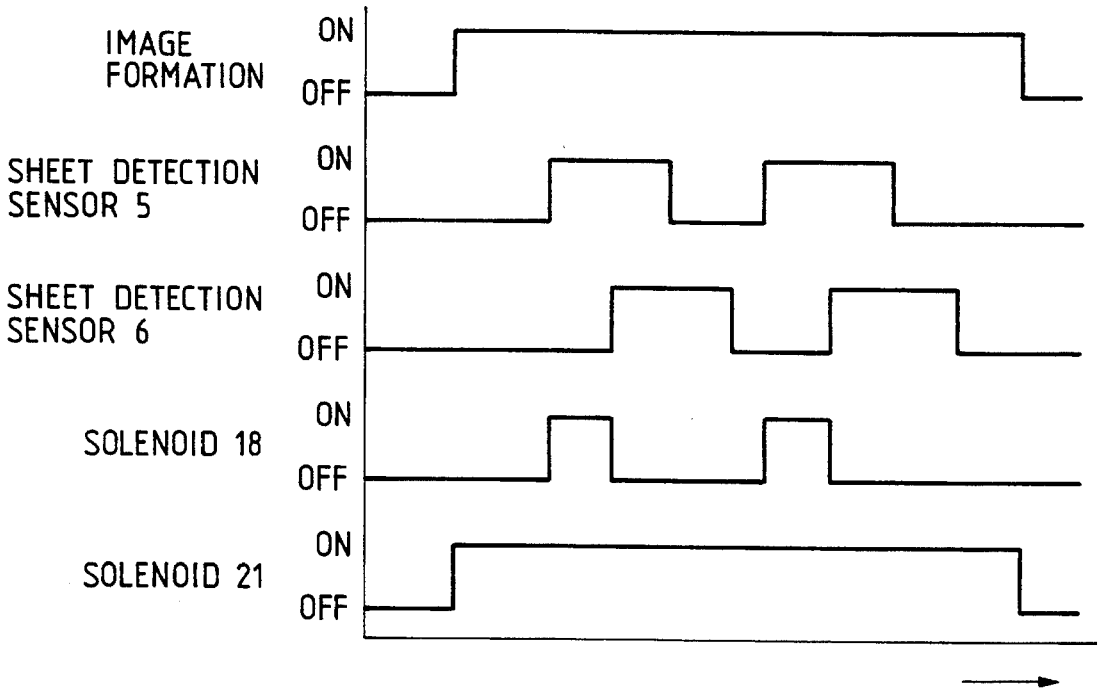
FIG. 6 is a timing chart for the operation of the device shown in FIGS. 1 to 3.

Now, the operation of the device will be described with respect to the timing chart of FIG. 6. When no sheet P is being carried inside the device, the solenoids 18 and 21 is turned off and the separation claw 16 is in the third state. When the image forming operation is started by pushing a copy start button (not shown), the sheet P is carried from the sheet feed unit 1, the fixed roller 8 is rotated, and the solenoid 21 is turned on to bring the separation claw 16 in the second state. When the sheet onto which the toner image is transferred is carried by the carrier belt 7 and detected by the sheet sensor 5, the solenoid 18 is turned on and the separation claw 16 comes in the first state. Then, the toner image is fixed onto the sheet P by the fixing device 4. Consequently, when the sheet P is detected by the sheet sensor 6, only the solenoid 18 is turned off to bring the separation claw 16 in the second state again. After that, if the next sheet P is continuously subjected to the image forming operation, the separation claw 16 is brought in the first state, and then, in the second state again, as in the case of the previous sheet P. The above operation is repeated for each of the subsequent sheets P. And after the image forming operation is finished, when the last sheet P is discharged onto the discharge tray 23, that is, when the copying operation is completed, the solenoid 21 is also turned off to bring the separation claw 16 in the third state.

As described above, the front edges of the sheets P are certainly separated by the strong contact pressure, while the contact pressure is decreased or made equal to zero after separating the front edges. Thus, the abrasion loss of the surface of the fixing roller can be reduced.

Also, since the separation member does not separate but remains in contact with the surface of the fixing roller even after separation of the front edges of the sheets P, separation failure and disturbed image can not occur.

In addition, as the separation member is not separated from the fixing roller while the fixing operation is continued, the attachment/detachment operation does not have to be repeated frequently.

Incidentally, though the separation member is provided for the fixing roller in the above-mentioned embodiment, one may be provided for the pressure roller. As the rotating member for fixation, the fixing roller may be replaced by an endless belt.

The present invention is not limited to the embodiment described above, but includes various kinds of modifications which fall within the range of the technical ideas of the present invention.

What is claimed is:

1. A fixing device comprising:

a rotating member for performing a fixing operation while a recording medium supporting an unfixed image is pinched and carried;

a separation member pressed against a surface of said rotating member to separate the recording medium from said rotating member; and switching means for switching a contact pressure of said separation member against the surface of said rotating member between a first contact pressure and a second contact pressure less than the first contact pressure, wherein said switching means switches the contact pressure from the first contact pressure to the second contact pressure during the separation of the recording medium from the rotating member, and after separating a front edge of the recording medium.

2. A fixing device according to claim 1, wherein said switching means also switches said separation member to a position where said separation member is separated from the surface of said rotating member.

3. A fixing device according to claim 2, wherein the first contact pressure and the second contact pressure are alternatively switched for each of the recording media during a continuous fixing operation, and said separation member is separated from the surface of said rotating member after the continuous fixing operation is finished.

4. A fixing device according to claim 1, further comprising a sensor for detecting a position of the recording medium, wherein said switching means switches the contact pressure from the first contact pressure to the second contact pressure in accordance with an output from said sensor.

5. A fixing device according to claim 1, wherein said rotating member is contactable with the unfixed image.

6. A fixing device comprising:

a rotating member for fixing an unfixed image on a recording medium performing fixation while the recording medium is pinched and carried;

a separation member pressed against a surface of said rotating member for separating the recording medium from said rotating member;

switching means for switching a contact pressure of said separation member between a first contact pressure and a second contact pressure less than the first contact pressure; and a sensor for detecting a position of the recording medium, wherein said switching means switches the contact pressure from the first contact pressure to the second contact pressure in accordance with the output from said sensor.

* * * * *

UNITED STATES PATENT AND TRADEMARK OFFICE

CERTIFICATE OF CORRECTION

PATENT NO. : 5,500,726
DATED : March 19, 1996
INVENTOR(S) : TAKESHI AOYAMA, ET AL.

It is certified that error appears in the above-indentified patent and that said Letters Patent is hereby corrected as shown below:

Column 3,
line 22, "is" should read --are--.

Column 4,
line 30, "alternatively" should read --alternately--.

Signed and Sealed this

Second Day of July, 1996

*Attest:*

*Attesting Officer*

BRUCE LEHMAN

*Commissioner of Patents and Trademarks*